US012161239B1

(12) United States Patent
Jewell

(10) Patent No.: US 12,161,239 B1
(45) Date of Patent: Dec. 10, 2024

(54) MOUNTED FLIP FRAME

(71) Applicant: Steven Jewell, Fairfax, VA (US)

(72) Inventor: Steven Jewell, Fairfax, VA (US)

( * ) Notice: Subject to any disclaimer, the term of this patent is extended or adjusted under 35 U.S.C. 154(b) by 0 days.

(21) Appl. No.: 18/665,720

(22) Filed: May 16, 2024

Related U.S. Application Data

(60) Provisional application No. 63/503,939, filed on May 23, 2023.

(51) Int. Cl.
*A47G 1/08* (2006.01)
*A47G 1/06* (2006.01)

(52) U.S. Cl.
CPC ..... *A47G 1/08* (2013.01); *A47G 1/0622* (2013.01); *A47G 1/065* (2013.01); *A47G 2001/0672* (2013.01); *A47G 2001/0694* (2013.01)

(58) Field of Classification Search
CPC .. G09F 7/22; G09F 1/12; A47G 1/065; A47G 1/0622; A47G 1/08; A47G 1/166
See application file for complete search history.

(56) References Cited

U.S. PATENT DOCUMENTS

| | | | | |
|---|---|---|---|---|
| 1,448,664 | A | 3/1923 | Hull | |
| 4,630,386 | A | 12/1986 | Wilson | |
| 5,161,321 | A | 10/1992 | Kuhnke | |
| 5,288,050 | A | 2/1994 | Armstrong | |
| 5,651,202 | A * | 7/1997 | Hewitt | G09F 7/10 206/39 |
| 5,988,365 | A | 11/1999 | McAdams | |
| 6,775,939 | B1 | 8/2004 | Juern | |
| 6,782,649 | B1 | 8/2004 | Adler | |
| 10,378,258 | B2 * | 8/2019 | Helmikkala | A47B 97/001 |
| 2002/0069567 | A1 | 6/2002 | Marino | |
| 2005/0063145 | A1 | 3/2005 | Homer et al. | |
| 2005/0155267 | A1 | 7/2005 | Hamilton | |
| 2007/0204499 | A1 | 9/2007 | Sudack et al. | |
| 2007/0266607 | A1 * | 11/2007 | Schult | G09F 1/12 40/734 |
| 2008/0165478 | A1 * | 7/2008 | McCoy | F16M 13/02 361/725 |
| 2009/0011151 | A1 | 1/2009 | Cruz | |
| 2009/0013576 | A1 | 1/2009 | Jake et al. | |
| 2010/0084538 | A1 | 4/2010 | Ming et al. | |

(Continued)

FOREIGN PATENT DOCUMENTS

| | | |
|---|---|---|
| DE | 202016100676 | 5/2017 |
| KR | 200440732 | 6/2004 |
| WO | WO2016203116 | 12/2016 |

*Primary Examiner* — Bradley Duckworth

(57) ABSTRACT

The invention is a mounted flip frame. The frame includes a mount assembly, slotted, retractable pivot arms, pivot pin(s), and a frame assembly with two sides for display. The pivot arms seat in the mount assembly and are retractable, biasing the pivot arms towards the wall. The pivot pin is connected to the frame assembly through slots in the pivot arms whereby the frame assembly rotates freely in the pivot arm slots when the pivot arms are extended. The frame assembly is rotated by swiping the frame assembly from either side of the mount opposite the pivot arms, using a single finger. The inertia of the swipe turns the frame beyond its perpendicular orientation causing the pivot arms' retraction mechanism to quickly bring the frame back to a flat, level position above the mount assembly showing the other side of the display item.

6 Claims, 12 Drawing Sheets

(56) References Cited

U.S. PATENT DOCUMENTS

| | | | |
|---|---|---|---|
| 2015/0107142 | A1 | 4/2015 | Burrous et al. |
| 2018/0119878 | A1 | 5/2018 | Oppenheimer |
| 2019/0298085 | A1 | 10/2019 | Johnson |
| 2021/0169238 | A1 | 6/2021 | Urena |

* cited by examiner

MOUNTED FLIP FRAME

REFERENCE TO RELATED APPLICATIONS

This application claims priority from U.S. provisional application No. 63/503,939 filed May 23, 2023.

BACKGROUND OF THE INVENTION

This application relates to the field of reversible frames for cards, photos, documents, coins, or other double sided display items.

DESCRIPTION OF THE PRIOR ART

Both U.S. Patent 2007/0204499 to Sudack et al. (2007) and U.S. Patent 2009/0013576 to Jake et al. (2009) show reversible wall-mounted frames that allow double sided objects to be displayed. Sudack uses a hinged mount and frame with a pivot in the frame that allows the display to be rotated when opened. Jake shows a mount connected to 2 pivot arms that connect to a vertically reversible frame through a pivoting axis on the frame device.

Adler, in U.S. Pat. No. 6,782,649 (2004) shows a frame that is reversible and wall-mounted. It uses a slotted frame top and bottom around a central pivot connected to a wall attachment.

Korean Patent KR200440732Y1 to 김영태 (2004), U.S. Pat. No. 4,630,386 to Wilson (1986), and German Patent DE202016100676 to WINDESA (2017) show examples of reversible picture frame types that use frames with double sided sliding inserts, slotted frame hangers, or magnetic catches to show the other side.

U.S. Pat. No. 1,448,664 to Hull (1922) is representative of a family of reversible frames suitable for use on desktops or flat surfaces, and thus not comparable to wall-mounted implementations of the type described herein.

The U.S. Pat. No. 5,161,321 to Kuhnke (1992) presents a display system with single, spring-loaded pivoting arm for a reversible wall panel. The patent lists the primary objective of the invention as providing approximately double the usable space of the area on which it is mounted. The frame uses a rotating pivot arm that allows the display to be rotated in a single direction to show the reverse side.

The WO Patent 2016/203116 to Helmikkala (2016) shows a similar device for a large board or to hide objects like TV screens, whiteboards and the like using a single pivot arm and a linear guide system within the fixed mounting surface to effect rotation.

DESCRIPTION OF RELATED ART

There is a long felt need for a mounted reversible flip frame that is simple to operate, fast, and encourages users to engage in flipping the display. Existing reversible frames hide their flipping mechanism, and require disparate hand motions to reverse the displayed image. Indeed, one could argue that hiding the method used to flip the frame is detrimental to the design, discouraging users from rotating the frame to see the other side. Ideally, the flipping mechanism should be operationally simple, fast, and not detrimental to the display contents.

Additionally, most reversible frames do not address the most common need for these frames, the desire to see the other side of a double sided object. Collectible trading cards, coins, documents, and other known double sided objects naturally inspire the viewer to want to see the other side of the object. Recognizing this, the present embodiment provides a frame solution for these common double sided objects that both protect and display them. Once the flipping mechanism is seen and understood, users can find new applications for these frames, including before/after photographs, tickets, custom cards, comic books, in/out door placards and other innovative double sided frame applications A secondary objective then is to protect the displayed contents within that frame as they may be valuable. Physical protection holds the double sided item in place as it is moved to reduce surface scraping and scratches. Trading cards, for example, can be destroyed by the sun's ultraviolet (UV) rays, which break down chemical bonds and cause colors to fade. Similarly, coins are damaged by the acid content in many common frame materials. Wood, paint, some plastics, and other common frame materials can release gaseous acids that can corrode and devalue coins. As a result, collectors need protection from both UV and materials that are acid-free. The present invention uses materials that provide physical and UV protection and are acid-free.

Most of the prior art designs presume that the operator will flip, retract, and retain the frame in a flat, level position as part of the flipping process, which can potentially lead to the dropping of the object, wall damage, or fingerprints on the wall where the user grabs the rotating components.

An improved mounted flip frame has a smooth flipping mechanisms and method, a visible indication that the frame can be flipped, protection for the displayed object, and a mechanism for retracting and retaining the frame against its affixed mount. The flipping operation should be smooth, easy to perform, fast, and capable of being operated with a single-finger swipe, like a smartphone or touch screen. The frame should have obvious flipping features and suggest that the flipping operation is desired.

A wall-mounted frame allows the user's collection to be mounted rigidly to the wall, and deters theft. If the flipping rotation is only in the plane above the fixed mount, the frames can be mounted closer together and many frames can be co-located on the same wall (e.g., an entire baseball team's trading cards).

The frame should be affixed to a mount that is secured, using screws or other methods, to the wall in a level position. The mount holds the frame from the wall so that the user's fingers do not touch the wall during operation, thus keeping the wall free from smudges induced by skin oils. Using mounting strips instead of screws to mount the frame can eliminate wall damage altogether, so that when removed no wall repair or cleanup is needed.

The general purpose of the present invention, then, is to improve upon the known deficiencies of the prior art to provide a novel, non-obvious solution to these problems which is not anticipated, rendered obvious, suggested, or even implied by any of the prior art reversible picture frames, either alone or in any combination thereof.

The present invention comprises, in its simplest form, a mount assembly, a frame assembly for displaying double sided items, at least two slotted, retractable pivot arms (hereinafter: pivot arms), and two or more biasing mechanisms. The mount assembly is essentially planar and has an outer periphery and an inner periphery. Further, the mounting assembly is adapted to be fixedly attached to an essentially planar surface, such as a wall. The frame assembly is essentially planar, rectangular in shape and houses the double sided display object. The frame assembly has at least one insert on its end. The frame insert(s) is/are centered on the sides of the frame assembly to provide the desired axis of rotation for the frame. The mounting assembly and frame assembly are coplanar and centered with each other in the closed position and the biasing mechanisms serve to keep them tight against one another. The open position is defined as any position during the rotation where the frame and mount assemblies are not coplanar, to include when the plane of the frame assembly is perpendicular to the plane of the mount assembly during rotation.

The first pivot arm is rotatably attached to the outer periphery of the mount assembly such that it aligns with the frame insert side when at rest. The second pivot arm is rotatably attached to the mount assembly on the same side as the first; but on the opposite corner. The first end of the first pivot arm rotatably connects with the bias mechanism (a spring for this embodiment) to retract the pivot arm towards the mount assembly. The first end of the second pivot arm is similarly biased, again pulling the pivot arm towards the mount assembly. The bias force is increased when the second end of a pivot arm is moved away from the mount assembly so that the pivot arms are closed unless an external force is applied.

The second end of each pivot arm is slotted to be rotatably connected to the frame insert. The slots allow the frame assembly to be rotatably attached to the mount assembly through means of a pivot pin. The pivot pin for each pivot arm is routed through the slot in each of the pivot arms before being fixedly attached to the frame assembly in the frame insert.

The slots allow the pivot pin to travel freely along their length, constraining the travel of the frame to the travel allowed by the slot length. The slots are configured to have a slot length that matches the desired travel of the pivot pin during a normal rotation of the frame. In the closed position, the slot end nearest the pivot shaft is very close to the pivot pin, ensuring that the frame assembly will rotate when pressed towards the center, and thus encouraging motion above the mount assembly only. The length of the slot on the far end of the pivot arm, opposite the pivot shaft, is determined by the necessary length to turn the frame assembly when it is attached to the mount assembly. When the frame assembly is fully opened and the frame assembly is perpendicular to the mount assembly, the frame insert is near the other slot end. Again, the rotation is encouraged because the rotation of the frame assembly is constrained to just the area above the mount assembly. The resulting arrangement further simplifies the flipping process because the pivot arms translate forces in non-ideal directions into forces that act to turn the frame assembly. Another primary advantage is that the pivot arms are not constrained and can move about the pivot pin to reduce friction forces. The resulting flip is operationally simple and the bias forces work to close the frame automatically in either direction, at any time. The result is that the user can flip the frame assembly with almost no effort and the frame will close quickly and automatically in a flat, level position atop the mount assembly.

In addition to the structures and features described above, the device can be comprised of additional structures and/or features. The structures and/or features allow for a more efficient and effortless use of the device.

One additional structure and/or feature of the devices is to install pivot arms on the opposite side of the mount assembly and frame assembly and install a second pivot insert and pivot pin in the frame assembly. This embodiment reduces stresses on the frame components due to friction forces that are not in the direction of rotation. The extra pivot arms and inserts also keep the user from unduly lifting, for example, the side opposite the pivot arms during the flipping process. Such stresses can cause breakage or longer term stretching or bending of the pivot arms. Because of these advantages, this is the embodiment detailed herein.

These and other objects, features and advantages of the mounted flip frame will become more apparent to one skilled in the art upon reading the following specification in conjunction with the accompanying drawing figures.

DETAILED DESCRIPTION

Figure 1:
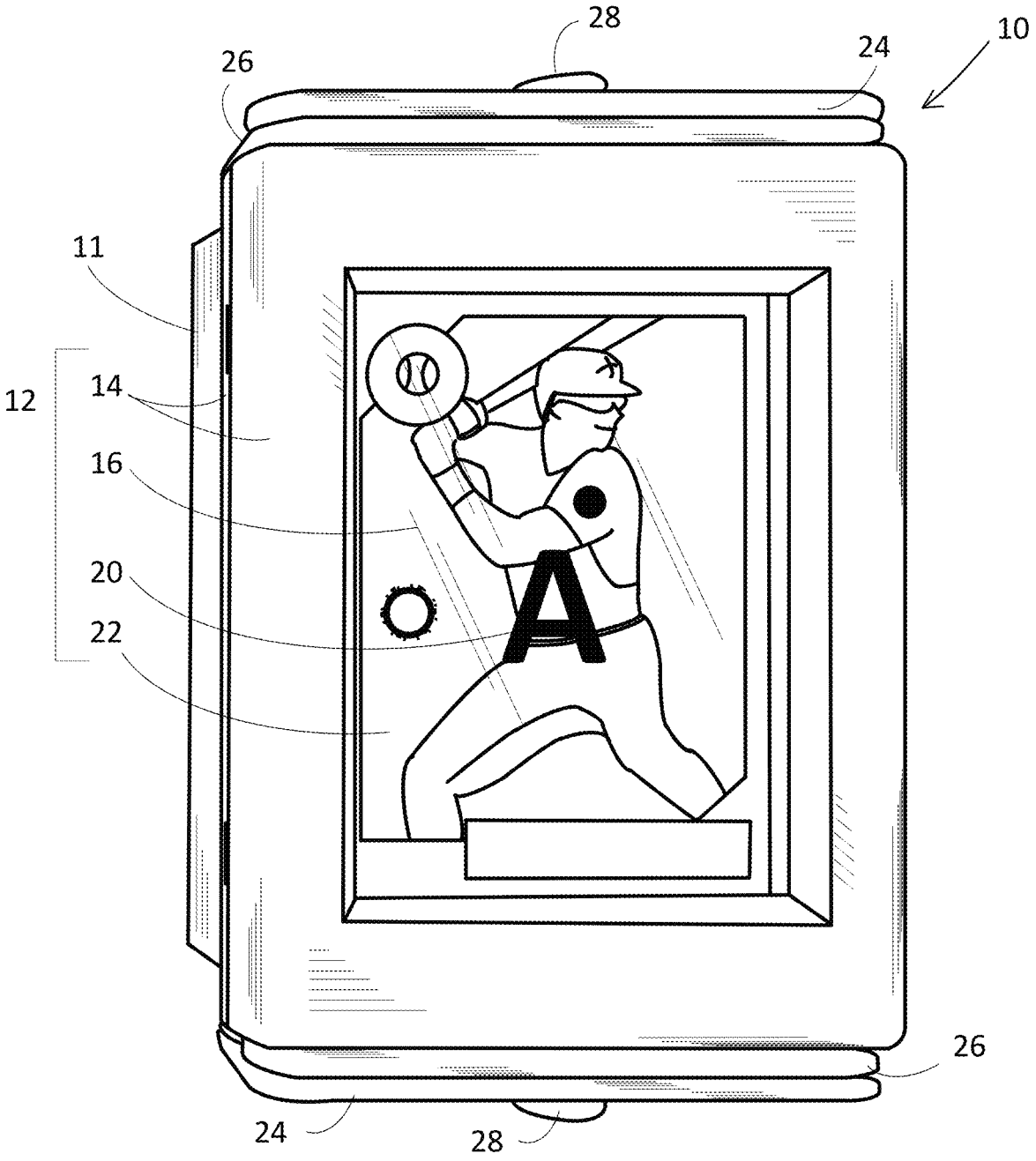
FIG. 1 is a perspective left-side view of the front of a first embodiment of the mounted flip frame.

FIG. 1 shows a perspective view of one embodiment of a mounted flip frame (10, hereinafter, the frame). The frame (10) comprises two assemblies: a frame assembly (12, FIG. 4) and a mount assembly (11, FIG. 6). This embodiment provides a reversible frame (10) for a double sided trading card, a coin, a document, two cards or photos mounted back-to-back, or any other double sided item for display, hereinafter referred to as the display item (22). The formed components of the frame (10) can be fabricated with plastic, aluminum, or any other material, but lightweight, non-ferrous, and preferably acid-free materials will work best. For descriptive purposes, the embodiment shown uses two pairs of pivot arms (24, 26) and two pivot pins (28), but the design will work properly with as few as one pair of pivot arms (24, 26) and a single pivot pin (28).

In the first embodiment, the mount assembly (11) and frame assembly (12) are fastened together with a top pivot arm (24) and a bottom pivot arm (26) affixed between them and connected to the frame assembly (12) by a pivot pin (28) on either end of the frame assembly (12). In the first embodiment, the display item (22) is housed within a magnetically fastened, transparent, rigid card holder (16), hereinafter, the magnetic holder (16, See also FIG. 4) to display a side A (20). The magnetic holder (16) may be similar in form and function to the One-Touch magnetic holder (16) offered by Ultra PRO of Commerce, CA. This magnetic holder (16) provides physical and UV protection for the display item, is water resistant, acid free, and holds the display item rigidly to minimize surface scratching and movement when flipped. The One-Touch magnetic holder (16) has also been widely adopted by card collectors to display and store their valuable cards.

Figure 2:
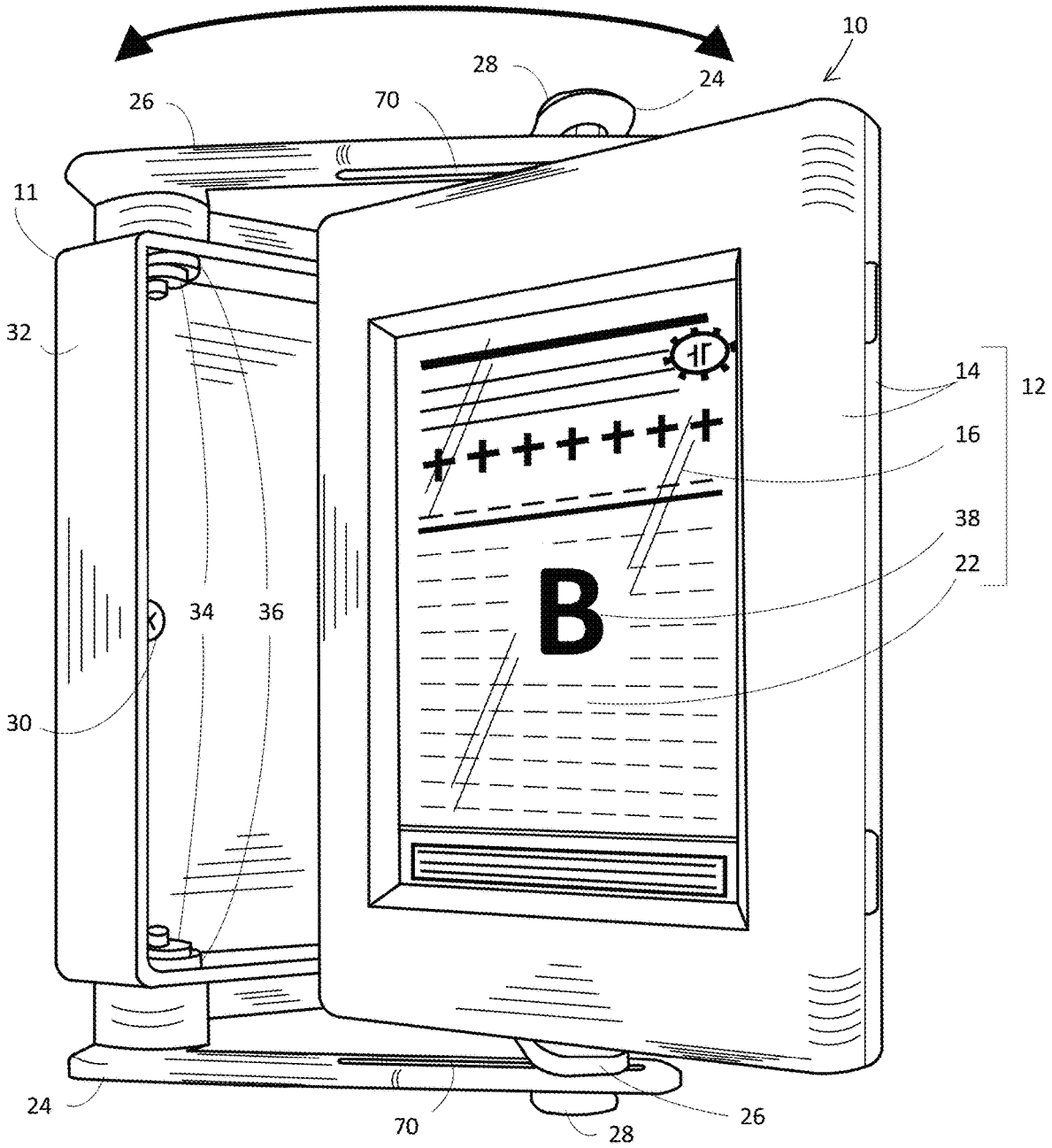
FIG. 2 is a perspective left-side view of the frame of FIG. 1 when the frame is being rotated from the near side in a counter-clockwise direction.
Figure 3A:
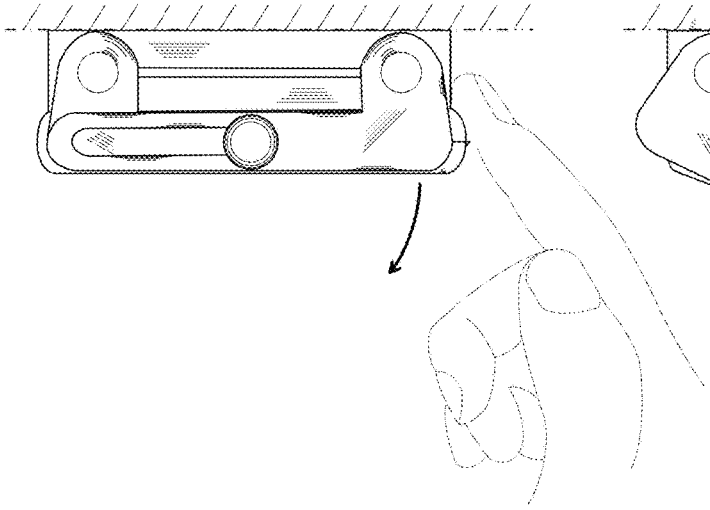
FIGS. 3A to 3D show a top view of the mounted flip frame of FIGS. 1 and 2 as it is rotated.
Figure 3B:
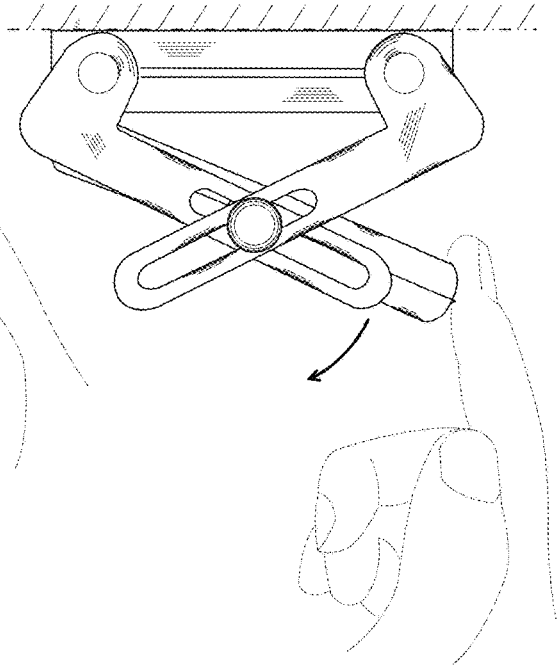
Figure 3C:
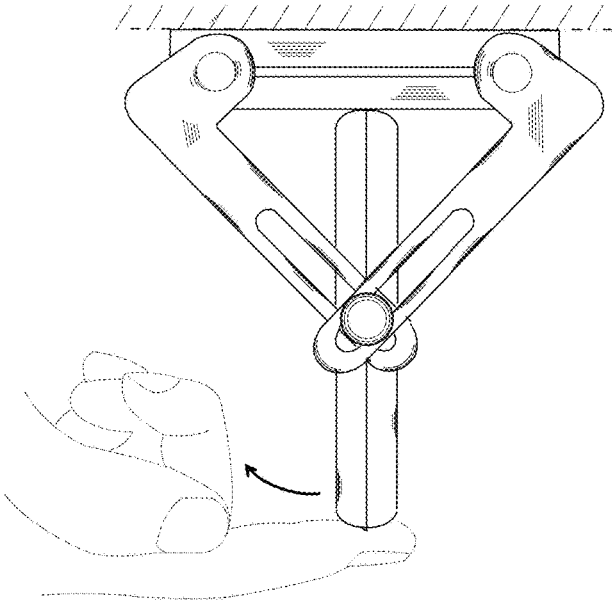
Figure 3D:
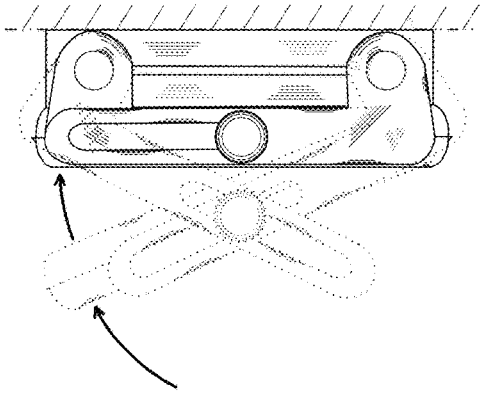

FIG. 2 shows the assembled frame of FIG. 1 in perspective as viewed from the left side of the frame (10). The figure shows the frame (10) in mid-flip as it traverses from displaying a side A (20, see FIG. 1) to a side B (38). The frame assembly (12) comprises two identical frame halves (14) and other components as shown in FIG. 4. This frame assembly houses the display item (22), the magnetic holder (16), and any other display components needed (See FIG. 9). The frame assembly (12), when attached to the fully extended pivot arms (24, 26), pivots freely around axis of the pivot pins (28), which are movably attached through the slots (70, see also FIG. 5A) in the extended retractable pivot arms (24, 26).

The mount assembly (11) comprises all components needed to hold the frame (10) to the fixed surface, as well as the components that hold and retract the pivot arms (24, 26) (See also FIGS. 5, 6 and 7). The spring-loaded retraction mechanism in this embodiment is one of many retracting means possible, including springs, weights, magnets, beveled hinges (See FIGS. 12 and 13 for US20047284740) or other biasing mechanisms. For example, the previously submitted provisional patent application (63/503,939) for this invention shows an embodiment using rubber bands as its biasing mechanism. The retracting means might also be implemented on a single or a single pair of pivot arms (24, 26) to reduce manufacturing cost.

This unique arrangement of the mount assembly (11), frame assembly (12) and pivot pins (28) allow the frame assembly (12) to pivot very tightly above the mount assembly (11) and then retract, with no human interaction, to a flat, level position. The pivot arm slots (70) limit travel of the frame assembly (12) around the centered pivot point so that the rotation occurs above the mount assembly (11) and does not traverse into spaces around the frame (10). The primary advantages of this arrangement are the case and speed with which the frame can be rotated, and the tactilely satisfying return of the frame to the mount caused by the retraction.

The pivot pins (28) are placed through the slots (70) in the retractable pivot arms (24, 26) and are attached to the midpoint of the frame assembly's (12) top and bottom. The pivot arms (24, 26) act to pull the frame assembly (12) back toward the mount assembly (11) to ensure that the frame (10) closes automatically in a precise, repeatable manner. The pivot pins (28) are not constrained to those of the type shown here. Any means for connecting the pivot arms (24, 26) to the frame assembly (12) (e.g. screws, shafts with bearings, etc.) with low friction force will work. See also the provisional patent application.

The frame assembly's (12) configuration is designed to be flipped with a single finger swipe so the design requires that friction force be minimized to rotate the frame assembly (12). The design also works better when the frame assembly's (12) center of gravity is through the pivot pins (balanced) and is as light in weight as possible.

FIG. 3 shows a top orthographic view of the frame (10) secured to a wall (dashed line) as it flips in a clockwise manner around the pivot pins (28, see FIG. 2). Refer to FIGS. 2, 5 and 6 for parts references for this figure. The frame assembly (12) starts in the closed position (FIG. 3A). A single finger on one side of the frame assembly (12) swipes it away from the mount and around the pivot pins (28). As the frame assembly (12) lifts, it engages the far side of the mount assembly (11) and the edge of the far pivot arm's (26, in this case) slot which ensure that it moves away from the wall (Sec FIG. 3B). The rotation continues until its position is perpendicular with the mount assembly (11, FIG. 3C). Once the inertia of the flip carries the frame assembly (12) to a position past perpendicular (See FIG. 3D dashed position, for example), the frame will disengage from the finger and snap into a closed position due to the retraction force of the pivot arms (24, 26). The result is that the frame assembly (12) is returned to the closed position shown in FIG. 3D, with the reverse side now showing.

For faster rotation, the frame assembly's (12) rotation can be abbreviated by flicking it from an initial position (FIG. 3A or 3B) with sufficient force that the frame rotates past the perpendicular position (FIG. 3C) with sufficient inertia to close the frame. Using dual pivot arms (24, 26) allows the frame to be flipped in a clockwise manner (as shown in FIG. 3) or in a counter-clockwise manner if the flipping instructions (FIGS. 3A to 3D) are reversed as in a mirror image. The design further reduces the friction necessary to flip because there is less friction against the retracting pivot arms (24, 26) than a fixed pivot arm. The flipping in this embodiment is easy for both right and left-handed users, uses less opening force, is fast, and is unbiased relative to its starting position.

FIG. 4 shows the frame assembly (12) diagram. The assembly process flows counter-clockwise from the display item (22) in the upper middle of the figure. The display item (22) is placed in the magnetic holder (16) and secured by means of a magnetic catch (58). Once secured, the loaded magnetic holder is placed within the frame half (14) as shown and held in place by card-holder ridges (48) against the magnetic holder seat (52). In this diagram, the display item (22) is mounted with side B (38) up so that the card's front side A (20) is not visible in the drawing. Note that the frame halves (14) are identical so the front and back assignments are arbitrary. With the magnetic holder (16) installed in the first frame half (14), we now fold a second frame half (14) over the first frame half (14) with the magnetic holder (16) installed and press down into the first frame half (14). The second frame half (14) secures the magnetic holder (16) and the pivot pin (28, see the assembly instruction for FIG. 7). The two frame halves (14) are held together with risers (40) and riser insets (44) as described below.

Figures 4A, 4B:
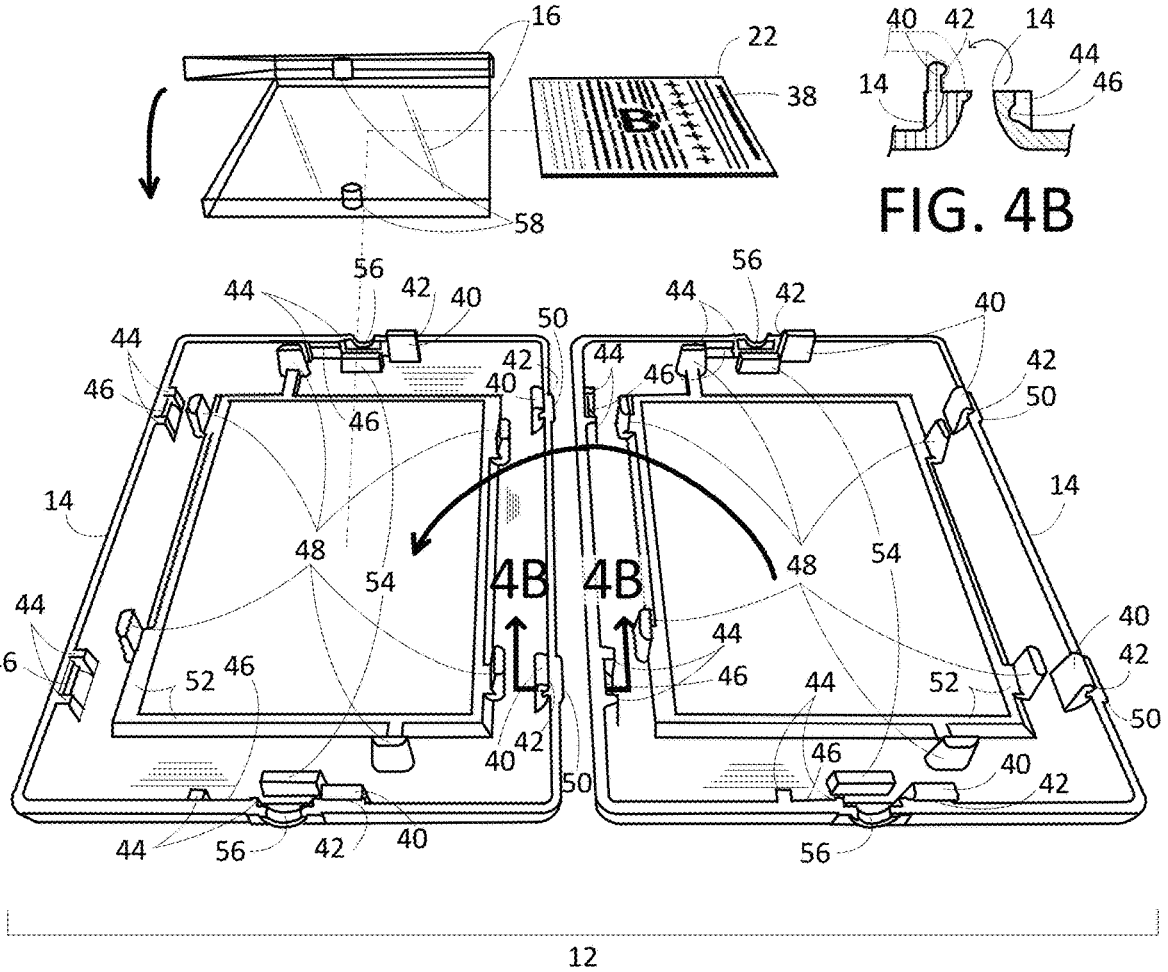
FIGS. 4A and 4B show a frame assembly drawing for the frame of FIGS. 1 and 2 and a sectional view showing how the frame halves are connected.

FIG. 4B shows a cross-sectional view of how each of six risers (40) connect to each of six riser insets and inset notches (44, 46). As FIG. 4B shows, there is a riser shoulder (42) that protrudes from the riser (40). Similarly, there is a riser inset notch (46) between each set of riser insets (44) on the frame halves (14). When the two halves of the frame assembly (12) are aligned, each riser (40) will fit between its matching two riser insets (44), and the frame halves (14) can be pressed together. When the two frame halves (14) are pressed together, the riser shoulders (42) deflect slightly and then lock into the riser inset notches (46) to secure the frame assembly (12) together. The frame assembly (12) is now assembled. A dashed line version of the riser inset (44) and riser inset notch (46) in FIG. 4B shows how the riser shoulder (42) and riser inset notch (46) lock to hold the frame assembly (12) together. The pivot pin (28) is installed through the frame pivot notch (56) on either end of the frame halves, and its installation is discussed in more detail during the discussion of FIG. 7E.

Figure 7A:
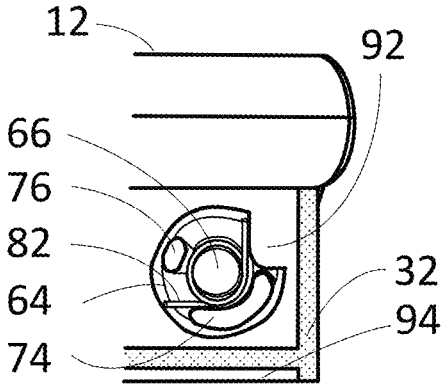
FIGS. 7A to 7E show cut-away detail views for the spring mounting with the frame shut and the frame open, a cutaway detail of an installed pivot arm in the mount, and a top and a front view of pivot pin assembly details for the frame of FIGS. 1 and 2.
Figure 7B:
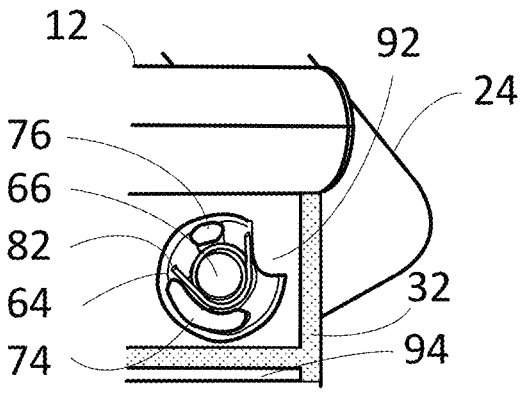
Figure 7C:
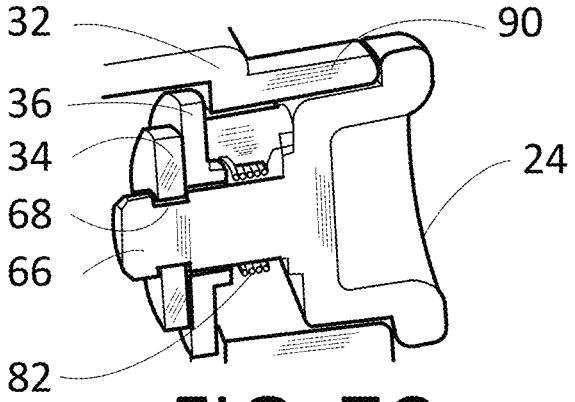
Figure 7D:
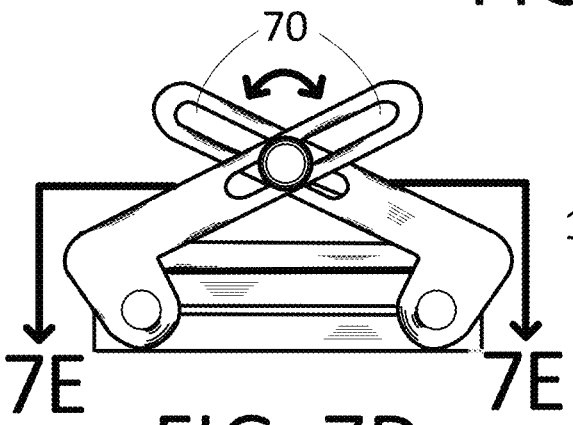
Figure 7E:
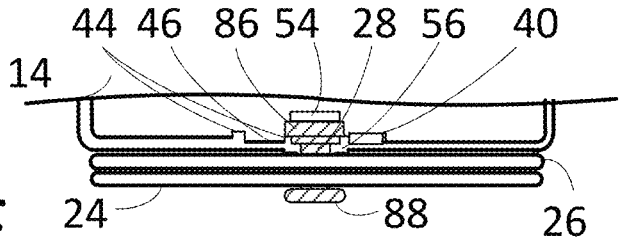

The frame removal tabs (50) are used to open the frame to install or remove a display item (22) in the magnetic holder (16), or to install the pivot pin (28) as detailed in FIGS. 7D and 7E. The user holds the frame down by pressing on the magnetic holder, and then lifts the frame removal tab (50) on the left side of the frame assembly (12) to remove the front half frame (14). The removed frame half (14) can then be re-installed once the pivot pin (28) is mounted or the new display item (22) is inserted into the magnetic holder (16). The frame half installation is identical to the process described previously where the removed frame is aligned with the installed frame and then pressed down to re-engage the riser locking mechanism (40, 42, 44, 46) to reconnect the two frame halves.

Figure 5A:
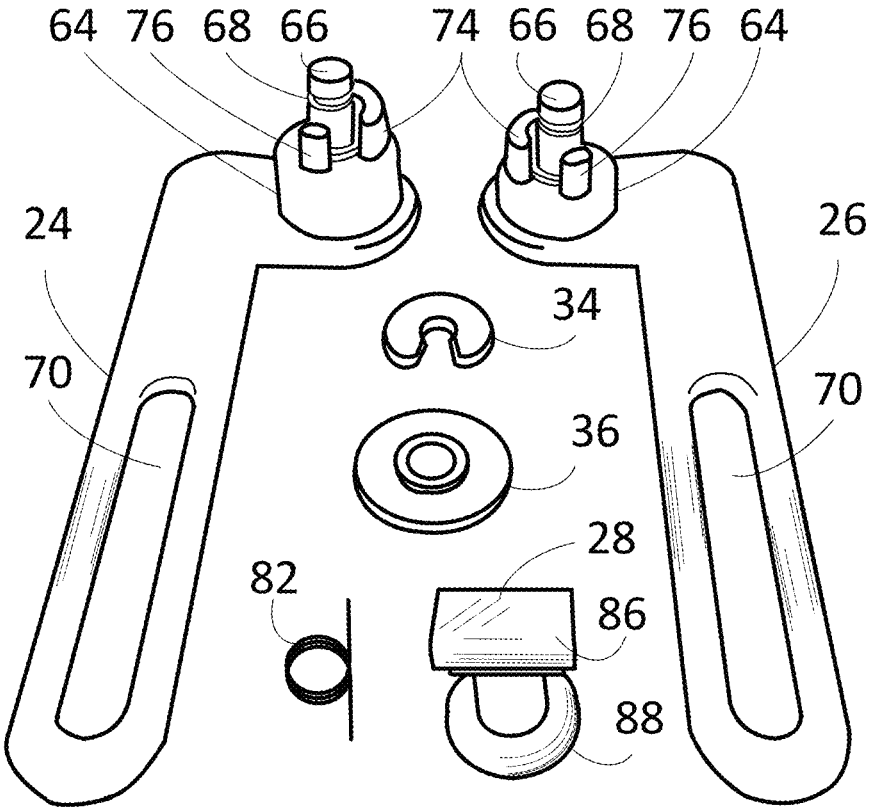
FIGS. 5A and 5B show a perspective view of the pivot arms, spring, collar washer, lock washer and pivot pin and an orthographic view of pivot arm details for the frame of FIGS. 1 and 2.

FIG. 5A shows a perspective view of the top pivot arm (24), the bottom pivot arm (26), and their associated mounting components. Referring to both FIG. 5A and FIG. 1, The two pivot arms (24, 26) are used on either end of the frame (10) to allow the frame assembly (12) to be rotated as shown in FIGS. 2 and 3. The pivot arms (24, 26) each have a pivot arm slot (70) that allows the pivot pins (28, see also FIG. 1) to slide freely within the pivot arms (24, 26) when installed. A detailed view and installation description for the pivot pin (28) is provided in details for FIGS. 7D, 7E. The pivot pins (28) are inserted through these slots (70) and into the frame assembly (12) to secure the frame assembly (12, see FIG. 1) to the mount assembly (11) to create the frame (10). The pivot pins (28) have a pivot pin foot (86) that is routed through the pivot arm (24, 26) slots (70) for mounting in the frame assembly (12), and a pivot pin head (88) that holds the pivot arms (24, 26) to the frame assembly (12). The design can be installed with as little as one pivot arm (24), but with only a single turning direction and with substantial binding against the side of the mount assembly (11) if turned in the incorrect direction. While a single pair of pivot arms (24, 26) can support the functionality of the frame, using two pairs of pivot arms (24, 26), as shown in the embodiment presented, allows the frame to rotate without undue stress on the pivot arms when rotating forces are away from the wall.

The two pivot arm types (24, 26) are similar in function, but the top pivot arm (24) includes a longer pivot arm shoulder (64) that allows the bottom pivot arm (26) to pass freely beneath it without binding. The pivot arm shoulder (64), working in conjunction with the mount cylinder (90, see FIG. 6) also provides lateral support to the pivot arm to protect the frame (10) from breaking due to the strong lateral forces caused by the flipping action. The pivot arms (24, 26) also have a pivot arm shaft (66) that passes through pivot arm cylinders (90, see FIG. 6) in the mount (32) to attach the pivot arms (24, 26) to the mount assembly (11).

FIG. 5A also shows related components for the installation of the pivot arms (24, 26) to the mount. The spring (82) sits within the mount cylinder (90, See FIG. 6A) between the pivot arms (24, 26) and the collar washer (36). The spring (82) provides the necessary torque to retract each pivot arm (24, 26). The collar washer (36) holds the spring against the pivot arms (24, 26) in the mount cylinder (90, Sec FIG. 6A), and the lock washer (34) fastens the pivot arms (24, 26) to the mount assembly (11, See also FIG. 6B, FIGS. 7A to 7C).

Figure 5B:
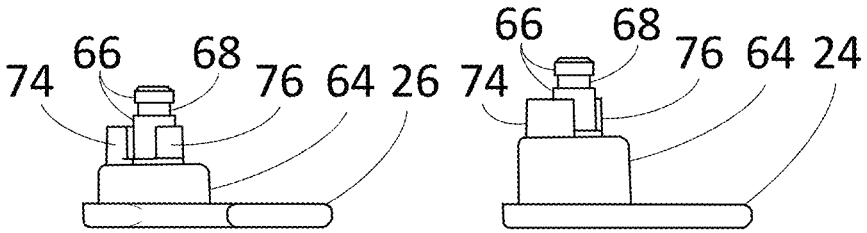

FIG. 5B shows an orthographic end view of the pivot arms (24, 26) and details for this embodiment. Each pivot arm uses a large nub (74) and a small nub (76) to hold the spring in the correct orientation and restrict rotation during installation and operation (Sec FIGS. 7A, 7B, and 7C). The pivot arm shaft (66) is notched (68) to provide an attachment point for the lock washer to hold the pivot arms (24, 26), spring (82), collar washer (36), and lock washer (34) to the mount assembly (11, See also FIG. 6B).

Figure 6A:
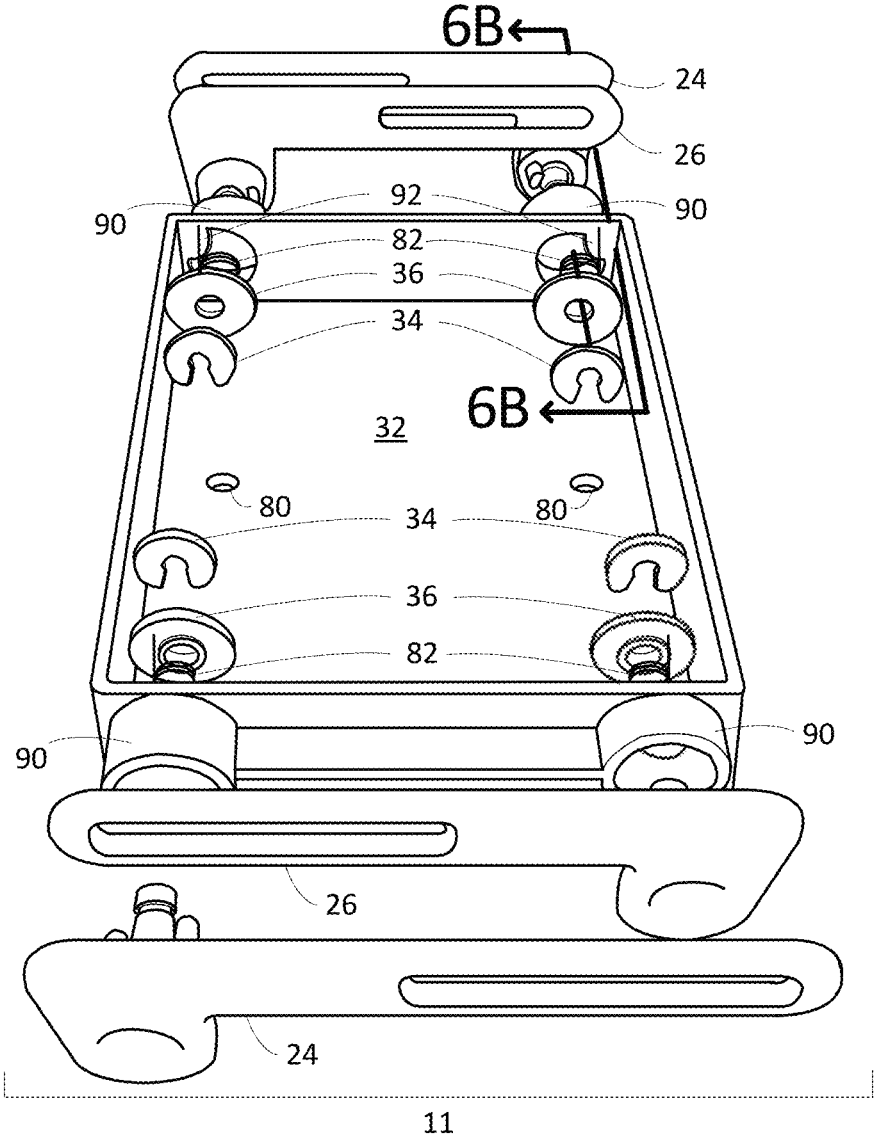
FIGS. 6A and 6B show a perspective mount assembly drawing and an orthographic side view of the pivot arm assembly for the frame of FIGS. 1 and 2.

FIG. 6A shows the mount assembly drawing. The pivot arms (24, 26) are each pushed through the mount cylinders (90) in the mount (32). They are then installed with a pre-bent spring (82) to provide retracting torque, a collar washer (36) to hold the spring in place, and a lock washer (34) that holds the components to the mount assembly (11). The assembly holds the pivot arms (24, 26) in place, provides retraction force, and allows the pivot arms (24, 26) to slide easily in the mount assembly (11). Mounting holes (80) are provided on either side of the mount assembly (11) to allow users to screw the frame (10) into the wall if desired. See also FIG. 8B for alternative mounting methods.

Figure 6B:
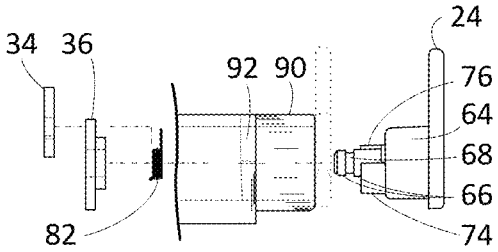

FIG. 6B shows a side view of pivot arm (24, 26) assembly process. This assembly starts with the installation of the appropriate pivot arm (24, 26) into the appropriate mount cylinder (90). The top pivot arm (24) is installed in the taller mount cylinder (90) such that the arm with the slot is butted against the mount cylinder (90). Next the spring (82), which is a 180-degree torsion spring (82) in this embodiment, is pre-bent to approximately 90 degrees to fit into the mount cylinder (90) against the spring ridge (92). Once the spring (82) is installed, the collar washer (36) is pressed against the spring (82) to hold it into place, and the opening in the lock washer (34) is pressed down into the pivot arm notch (68) to hold the pieces in place. The process is repeated for the other top pivot arm (24), and then in mirror image to both bottom pivot arms (26).

FIGS. 7A through 7C show details of the top pivot arm (24) installation with the collar washer (36) and lock washer (34) removed. FIG. 7A shows a cutaway view of the inside of the mount assembly (11) showing the top pivot arm (24), the pre-bent torsion spring (82), the large and small nubs (74, 76) and the spring ridge (92) within the mount (32) after the pre-bent spring has been installed. FIG. 7B shows the same detail when the top pivot arm (24) is lifted, which increases the spring force according to Hooke's law. FIG. 7C shows the same assembly from a side sectional view with the collar washer (36) and lock washer (34) reinstalled. The detail shows the top pivot arm (24) mounted in a mount cylinder (90) with the compressed spring (82), collar washer (36) and lock washer (34) installed coaxially with the pivot arm shaft (66). Pushing the lock washer (34) onto the pivot arm notch (68) locks the components in place with minimal friction so that the top pivot arm (24) will freely rotate within the mount cylinder (90) to retract the frame assembly (12) when it is attached. The process is repeated for the other top pivot arm (24) and is then repeated for the bottom pivot arm (28) in the short mount cylinders (90) of both sides, using a mirror image of the install diagrams of FIGS. 7A and 7B.

The springs (82) used in the frame (10) are selected to provide just enough motive force to reliably close the frame assembly (12) against the mount assembly (11) through the pivot arm (24, 26) forces. The resulting automatic closure should thus be smooth and without excessive force. The measured spring torque for the embodiment shown is about 0.15 inch-pounds per pivot arm (24, 26) when implemented with low friction parts. Excessive spring torque can cause the frame assembly (12) to snap back into the mount assembly (11) with such force that design life is affected and users are hesitant to use the device. For frames (10) designed to be mounted in a landscape orientation (See FIG. 9), additional spring forces are needed to counteract the weight of the frame assembly (12) and keep the frame (10) closed (See FIG. 3A).

FIGS. 7D and 7E show details associated with the installation of the pivot pin (28). The process starts with the removal of the frame half (14) furthest from the mount assembly (11) so that the pivot pin (28) can be installed. These diagrams and the pivot pin (28) detail drawing in FIG. 5A show how the pivot pin is installed. FIG. 7D shows that the pivot arms are raised on one side of the frame (10) and the pivot pin foot (86) is threaded through the slot (70) of the top pivot arm (24) and then twisted slightly (See FIG. 7D) to be threaded through the slot (70) of the bottom pivot arm slot (26).

FIG. 7E shows a top view of the frame (10) looking down at the front of the frame assembly (12) with the top frame half (14) removed. The view shows that when the pivot pin (28) is routed through both pivot arm slots (70) (See FIG. 7D, previous steps), it is then inserted into the integrated receptacle for it framed by the frame pivot notch (56) and the pivot pin restraint (54); the pivot pin foot (86) being held between the pivot pin restraint (54), the riser inset (44), and a matching riser (40) on the opposite side. The spring force exerted by the pivot arms (24, 26) and the friction provided by the adjacent frame (14) pieces hold the pivot pin in place. The pivot pin (28) on the other end of the frame assembly (12) is then installed in the same way. The pivot pins (28) will remain in place when the frame is re-opened due to the retraction forces. The removed frame half (14) can then be replaced (See FIG. 4), and the frame (10) is operational and ready for use. The pivot pin (28) length and shaft diameter are sized so that the pivot arm slots (70) move smoothly around them, but are not loose.

Figure 8A:
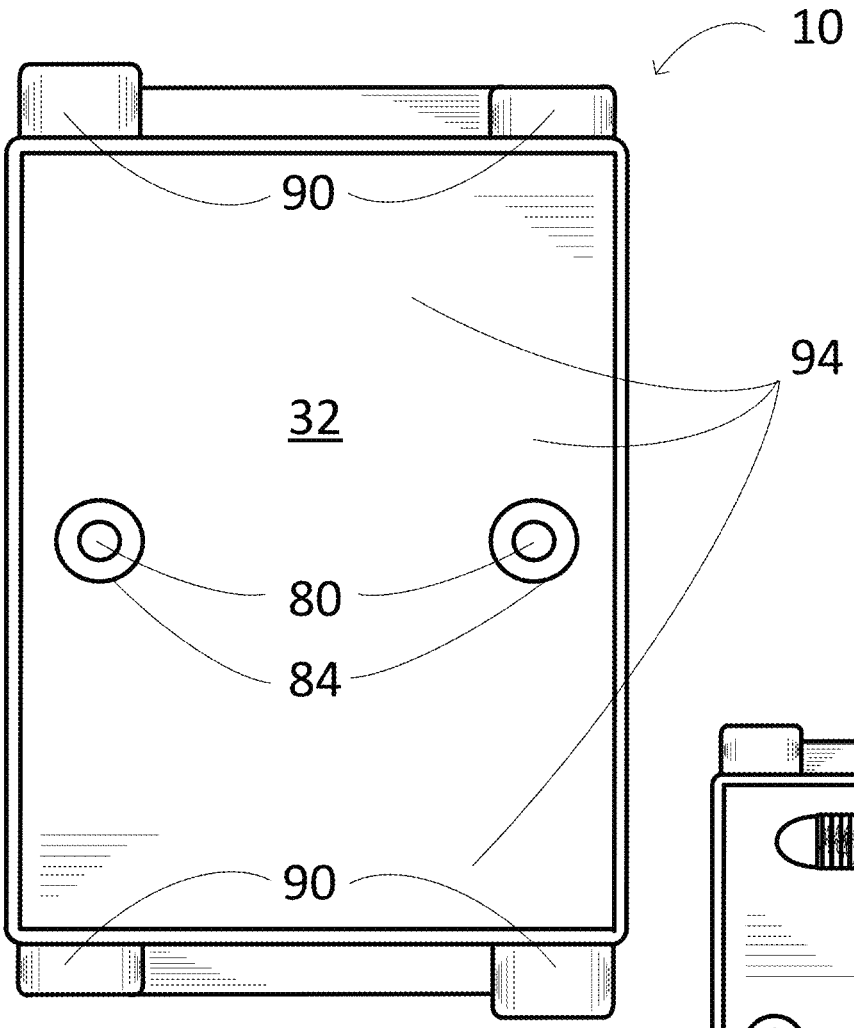
FIGS. 8A and 8B show a back view of the mount showing mounting details for the frame of FIGS. 1 and 2.
Figure 8B:
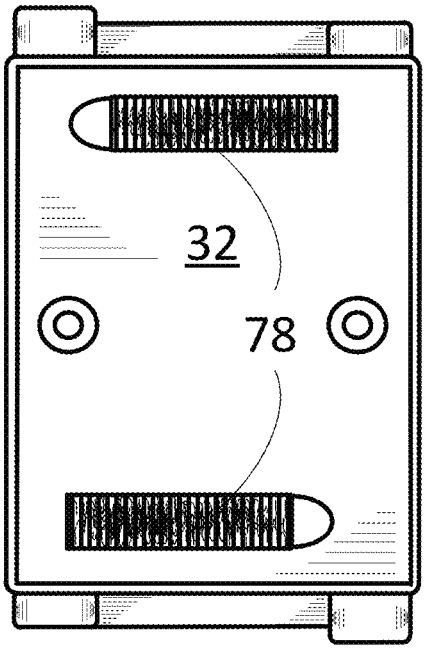

FIGS. 8A and 8B show two orthographic views of the bottom of the mount (32). The views show that the area under the mount has an underside cavity (94, see also FIGS. 7A and 7B). This cavity allows the user to use damage-free hanging mounting strips (78) like the Command brand manufactured by 3M of St. Paul, MN. The mounting strips (78) allow the frame (10) to be mounted on drywall surfaces, as well as glass or other less traditional mounting surfaces without causing mounting damage to that surface (See FIG. 8B). The mount under cavity (94) also hides the strips to provide a more professional look when the frame (10) is mounted.

FIG. 8A also shows the mounting holes (80) and mounting hole supports (84). The mounting hole supports (84) circle the mounting holes, and are flush with the bottom of the mount (32) to hold the base of the mount (32) securely to the mounting surface without flexing when the mounting screws (30, See also FIG. 2) are inserted through the mounting holes (80) and tightened.

Operation and Alternative Embodiments

FIGS. 2 and 3 show that the mounted flip frame (10) is rotated with a single finger swipe to flip the display item (22). Two pairs of pivot arms (24, 26) are visible, signaling the user that the frame is meant to be flipped. The flipping means is safe and simple, and is designed to keep the walls around the frame (10) clean and smudge free. The design of the frame (10) is intentionally kept as small as possible to minimize the required rotation force, and to allow users to mount several frames (10) on a wall close to each other. This allows grouping of frames to illustrate relationships like an entire team or an entire family in a minimal space.

In operation, the frame's (10, See FIG. 4) contents can be changed readily by holding the center of the magnetic holder (16) down while lifting on the left side's frame removal tabs (50) to remove the top frame half (14). To change the contents, remove the magnetic holder (16) from the remaining frame half (14), open it, replace the display item (22), close it, and return the magnetic holder (16) with its new contents into the remaining frame half (14) so that it is retained by the card-holder ridges (48). Finally, align and insert the previously removed frame half (14) onto its mating frame half (14) and press firmly to engage the riser locks (40, 42, 44, 46). The frame (10) is now ready for flipping.

FIGS. 2, 6 and 8 show how the frame (10) is mounted to the wall. The frame (10) can be secured to the wall with mounting screws (30) or with mounting strips (78). A level may be used to ensure that the installed frame (10) is level before mounting. For the mounting screws (30) option, two of the mounting screws (30) are inserted through the mounting holes (80) into the wall or other fixed surface. The mounting screws (30) are installed by rotating the frame assembly (12) to a perpendicular position above the mount assembly (11, see FIG. 2) and screwing them into the wall or mounting surface through the mounting holes (80). Removal of the frame (10) is done the same way; moving the frame assembly (12) to a perpendicular position, and then unscrewing the mounting screws (30).

If desired, the frame (10) can also be mounted using the mounting strips (78, See FIG. 8B). The frame (10) uses mounting strips (78) affixed to the reverse side of the mount assembly (11) as shown in FIG. 8B. The strips are installed and removed in accordance with the mounting strips' (78) vendor's instructions.

The retraction and retention mechanism for the frame (10, see FIG. 2) uses springs (82) in the pivot arm (24, 26) assemblies to retract and retain the frame assembly (12) into the fixed mount assembly (11). The resulting automatic closure is level and aligned and satisfies the user in a fashion like that of self-closing cabinets. The simplified turning provides a pleasing tactile response that encourages repeat turning. The result is that users will seek to flip the frame (10) whenever they identify the two sets of exposed pivot arms (24, 26) of this embodiment. This non-obvious exposure of the pivot arms (24, 26) is designed to reinforce their desire to flip and provide a visible indication to the user that this is a mounted flip frame (10).

The magnetic holder (16, See FIG. 4A) protects the display item (22) inside from scratches and damage, while providing UV protection using an ultra-clear material for long-term protection and optimal display. The magnetic holder (16) and the frame's (10) components also use acid-free materials to substantially reduce the threat of corrosion to a coin or metal display item (22). The magnetic holder (16) in this embodiment is sized for 63.5 mm×88.9 mm (2.5 inch×3.5 inch) trading cards, gaming cards, wallet-size photos, or other display items of this size or smaller, but the magnetic holder may hold other protected items of other sizes or in other embodiments (See FIG. 9). While this embodiment displays a small display item (22), other embodiments may use larger holders and larger display items, such as pictures, documents, letters, or photos in standard United States (US) (e.g. 5"×7", 8.5"×11", etc.) or other sizes.

The frame's (10, see FIG. 2) design is novel because its' pairs of pivot arms (24, 26) simplify the turning of the display item (22) relative to hinge-pivot designs or fixed pivot designs of the prior art. The arrangement of the pivot arms (24, 26), coupled with their slot (70) and pivot pin (28) allow the pivoting axis to be rotated above the surface of the fixed mount assembly (11) with a single finger swiping action to turn the frame, a feature that is a familiar motion to smart phone users. This pivot arm arrangement also keeps the frame (10) away from the wall by using a fixed mounting assembly (11) that allows users to turn the frame assembly (12) without incidental contact with the wall surfaces (See FIG. 2).

The frame (10) can be flipped repeatedly in either direction (clockwise or counterclockwise). This allows left or right-handed users to swipe the frame (10) with equal case and no loss of functionality. The ability to mount the frame (10) in an upright (portrait) orientation, or a horizontal (landscape) orientation (See FIG. 9) also provides unique benefits to the collector. The first orientation supports upright display items (22), like the trading card shown in FIG. 1. The second orientation supports display items (22) that have their reverse side upside down relative to the opposite face. For example, all coins from the United States use a coin orientation, a term for coins where the designs for each side of the coin are upside down with respect to each other (coin alignment). The horizontal orientation then allows coins that are flipped in the frame (10) to always have their designs upright.

Note that the aspect ratio of the frame (10) is also variable. A simple variant of the embodiment provided (not shown) would have pivot arms (24, 26) attached to the longer side of the mount and frame assemblies (11, 12), to show the reverse side in a medal alignment. Medal alignment is where the landscape display object has a reverse side that is right-side-up relative to the front. The functionality of such a frame (10) would be identical to that of the presented embodiment.

Figure 9:
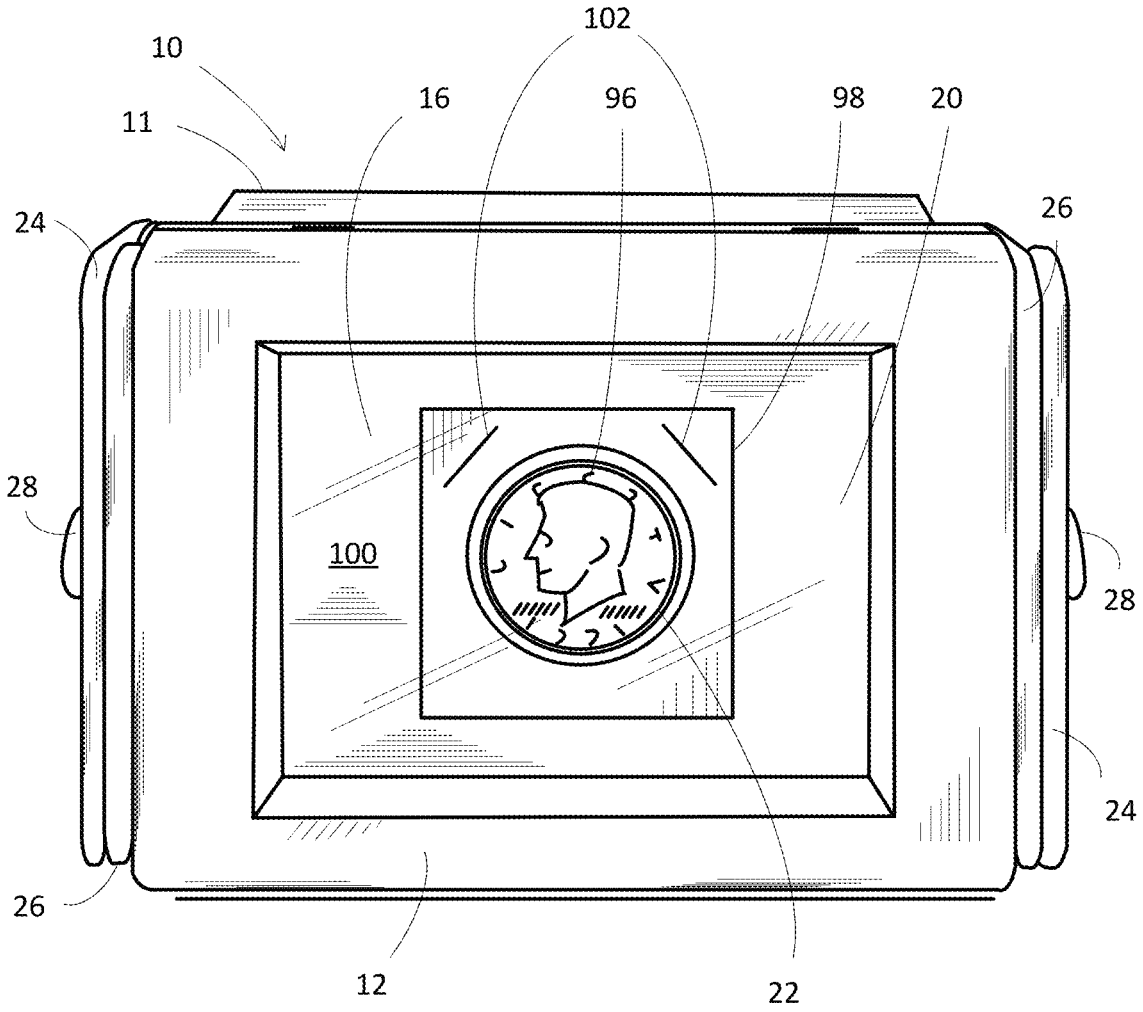
FIG. 9 Is a front perspective view of an embodiment of the frame of FIGS. 1 and 2 with a coin inserted.

FIG. 9 shows a front perspective view of an alternative embodiment of the mounted flip frame (10). In this embodiment, the display item (22) is a coin (96) mounted in a stapled (102) coin sleeve (98). Different sizes of coin sleeves (98) may be used to accommodate commonly used coins, but all have a common exterior dimension (nominally 50.8 mm square, or 2" square). The smaller dimensions of the coin sleeve (98) require a coin sleeve retainer (100) to center the coin sleeve (98) in the magnetic holder (16). The coin sleeve retainer (100) is made with an acid-free material to mitigate corrosion of the coin metal. As noted earlier, the resulting flip of the coin (96) in the frame assembly (12) will show the reverse side of the coin (96) right-side up. This landscape variant can be fashioned from the original portrait version by turning it on its side. Larger springs (82), larger magnetic holders (16), or both may be needed to support this embodiment.

Figure 10A:
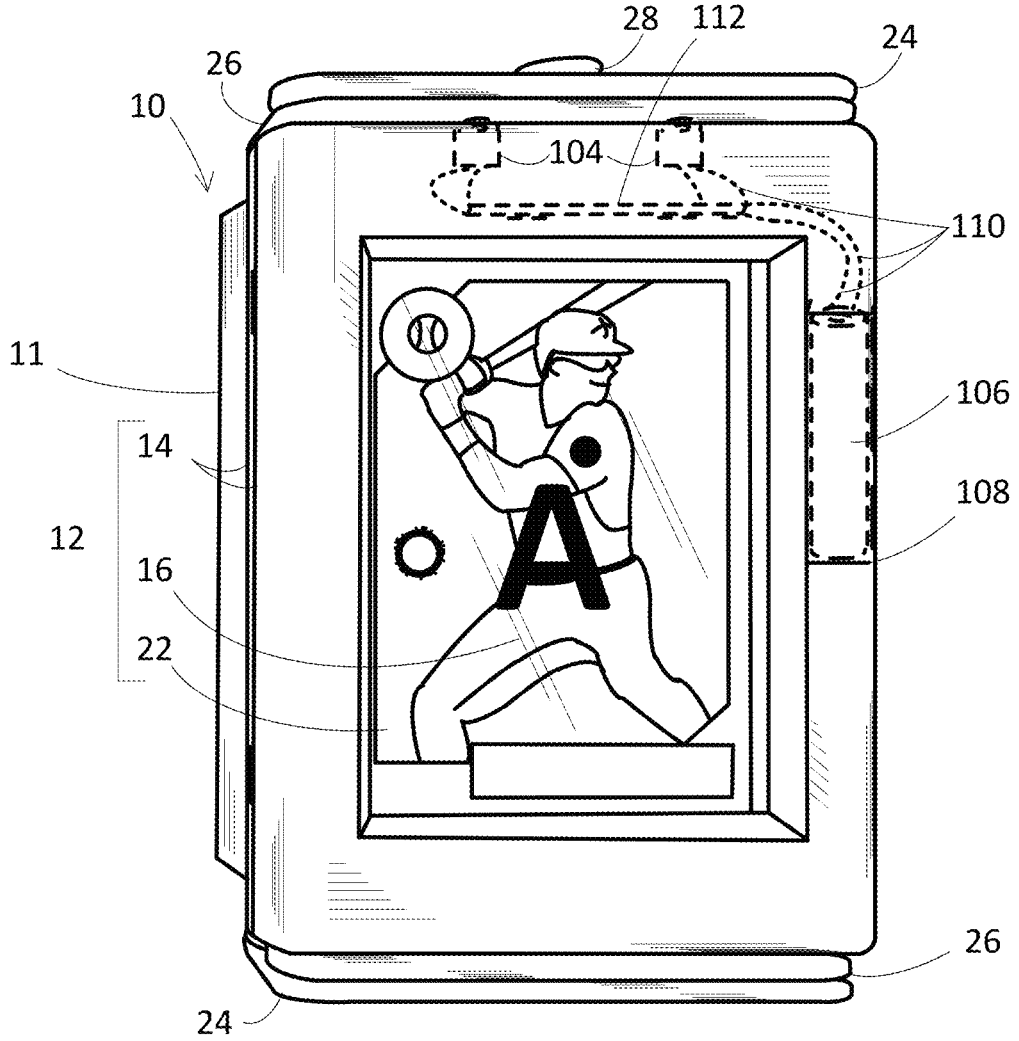
FIGS. 10A to 10C show a front perspective cut-away view, a printed circuit board perspective view, and an electrical schematic for an embodiment of the frame of FIGS. 1 and 2 with an incorporated light source.
Figure 10B:
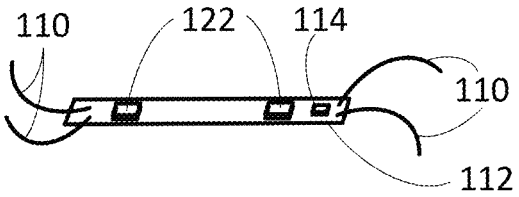

FIG. 10A presents a cut-away view of an alternate embodiment of the frame (10). In this embodiment, one or more light sources (e.g., Light Emitting Diodes (122, or LEDs), are affixed to a printed circuit board (112) and are mounted above the transparent magnetic holder (16) to illuminate the display item (22). FIG. 10B shows a notional design for the printed circuit board (112), which provides traces and pads to mount the LEDs (122) and a current-control resistor (114) to implement the circuit shown in FIG. 10C. Wires (110) are routed within the frame assembly (12) to make the electrical connections. Two momentary switches (104) are mounted in a recessed fashion at the top of the frame (10) to close the circuit and shunt current to the LEDs (122) through the resistor (114). When either momentary switch (104) is depressed, current flows through the LEDs (122) and the display item (22) is illuminated. A battery holder (108) holds a battery (106) that powers the circuit. Two momentary switches (104) are used on opposite corners of the frame assembly (12) so that the light can be activated from either side of the frame assembly (12). The pivot arms (24, 26) may be similarly modified to allow for access to this space, or the switches (104) might be moved to the front of each frame half (14). A unique property of this design is that the transparent magnetic holder (16) will act as a light pipe to provide a brighter and more uniform illumination of the display item (22) than that of a traditional top mounted lighting source. It can also light both sides of the display item (22) simultaneously with the same LEDs (122) if the LED is centered on the magnetic holder.

Figure 11A:
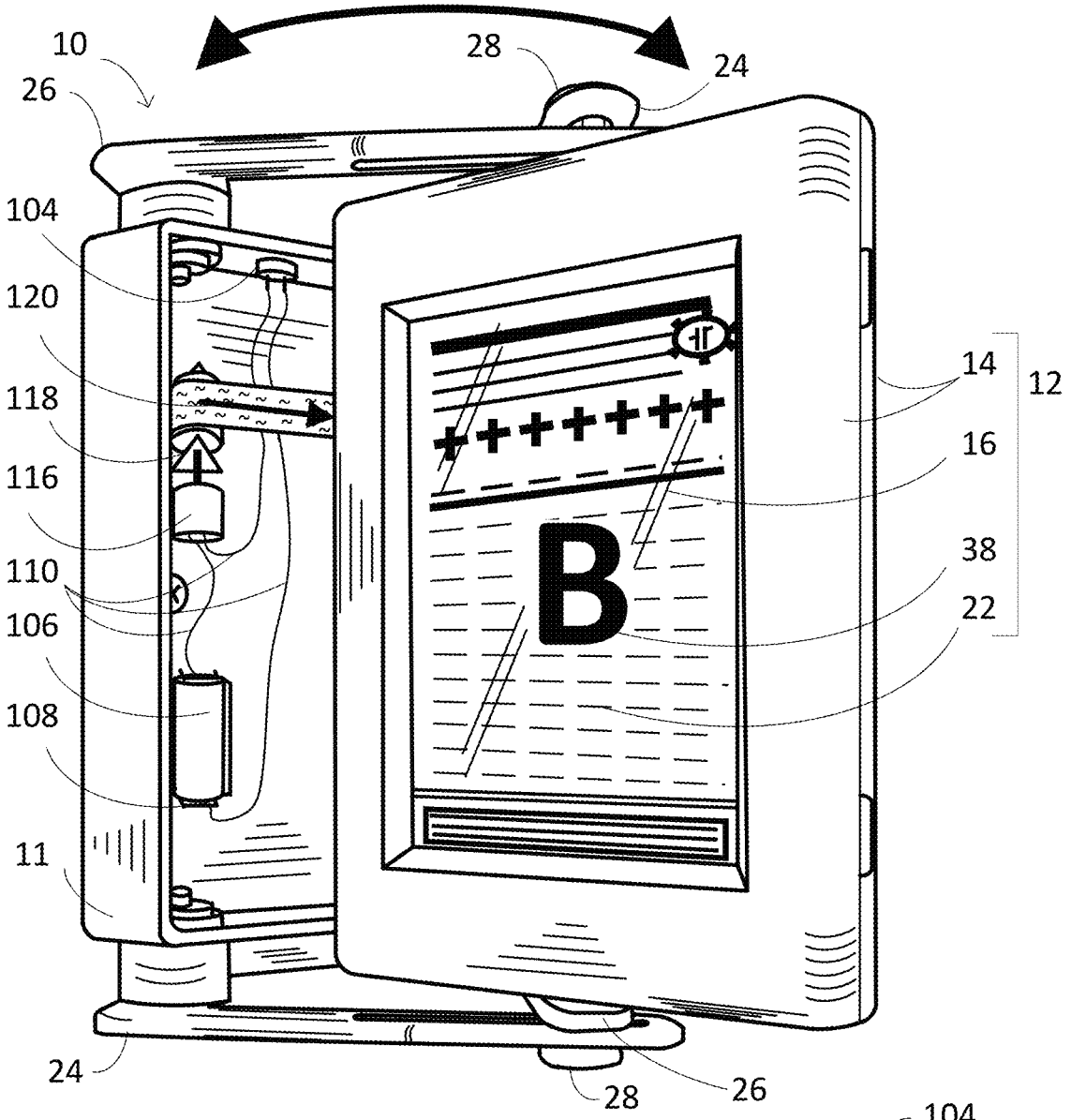
FIGS. 11A and 11B show a perspective left-side view, and an electrical schematic for an embodiment of the frame of FIGS. 1 and 2 with an incorporated push-button flipping mechanism.
Figure 11B:
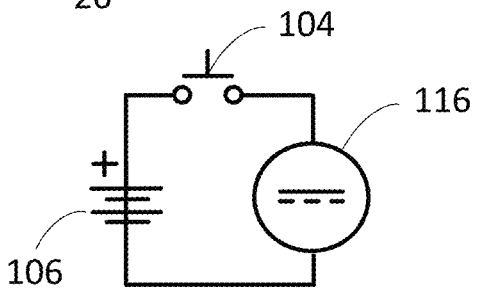

FIG. 11A. shows a front perspective view of an alternate embodiment that rotates the frame assembly (12) above the mount assembly (11) by means of a momentary switch (104). The figure also shows the battery (106), its holder (108), wire (110), and a Direct Current (DC) motor (116) connected to a linkage (118) that in turn drives a rolling belt (120). The frame assembly (12) is shown rotated to allow the components to be observed. In normal operation, the frame assembly (12) is flat against the mount assembly (11) when the momentary switch (104), now mounted in the mount assembly (11), is depressed. FIG. 11B. shows a simple circuit for the embodiment, showing that the battery (106) powers the DC motor (116) when the momentary switch (104) is depressed. The DC motor (116) drives the linkage (118), which acts to raise and turn the rolling belt (120) when the motor is powered. When the linkage is raised, the belt, which is rubber or some other tacky surface, engages the frame assembly (12) to push the frame assembly (12) laterally. This lateral movement is transferred to a turning force by the pivot arms (24, 26) which rotate the frame assembly (12) around the pivot pins (28) to a point past the perpendicular position with some initial inertia. The resulting inertia then causes the retracting pivot arms (24, 26) to bring the frame assembly (12) back to rest against the mount assembly (11) in a retracted, level position. This rotation will continue until such time as the momentary switch (104) is released.

Figure 10C:
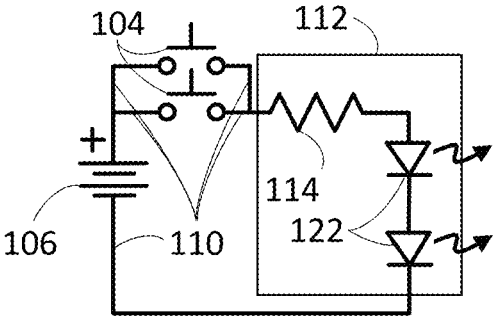
Figure 12:
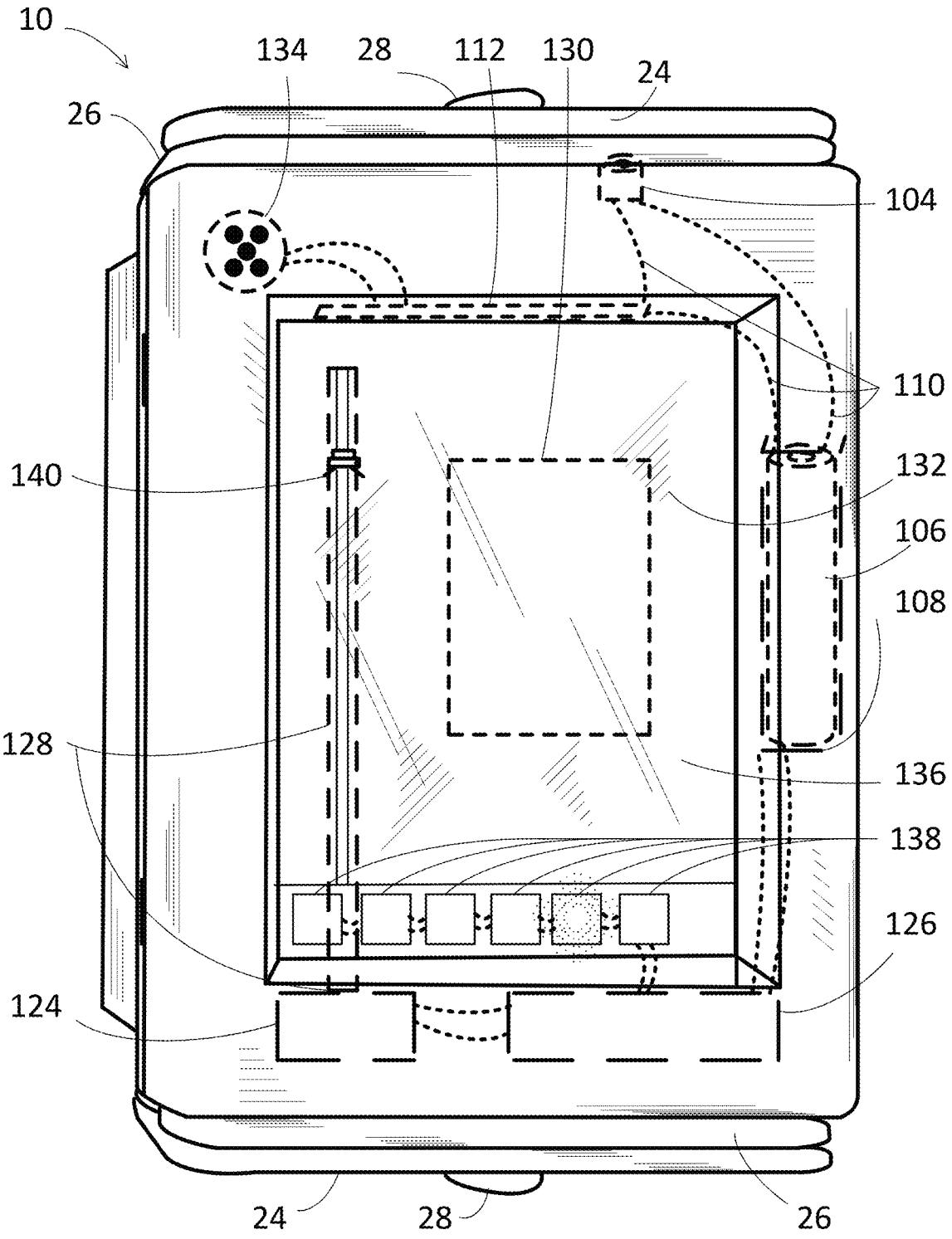
FIG. 12 Is a cut-away view of another embodiment in which a game is installed in a frame similar to that presented in FIGS. 1 and 2.

FIG. 12 shows a cut-away view of an alternate embodiment of the frame (10) wherein the display item (22, not shown) is replaced with a game. In this embodiment, the battery (106), battery holder (108), momentary switch (104), printed circuit board (112), wires (110), and circuit of FIG. 10C are supplemented with parts to provide a mechanical or electronic game. Example parts might include a motion element (124, e.g., a motor), a speaker (134), a score indicator (138), a computer controller (126), and a mechanical linkage (128) to transfer motion to a game token (140) to provide a game experience. The entire assembly would be encased in a transparent cover (132, clear acrylic, for example) on either side, and a backdrop (136) might be provided to hide the working components from the front or back view. The game players would use the momentary switch (104) atop the frame (10), for example, to control the game play for higher scores or other rewards. This embodiment could be reversed to play a different game, or to provide a continuation of a game from the other side.

Adding a computer controller (126) within the frame (10) enables remote control capabilities as well. For example, by housing the controller (126) circuitry with that of FIG. 11, the frame might be rotated with a remote control.

The reversible nature of the frame (10) can provide educational benefits. A common element of museums are boxes, levers or sliding panels that show a question and reveal an answer when moved. The frame (10) might be used in this fashion to illustrate a famous person, place, or thing (for example), with a brief description on the reverse side. In the example of the game of FIG. 12, for example, descriptive text (130) on the reverse side might explain the mechanical motion or other aspects of the game's design.

In describing the above embodiments of the invention, specific terminology was selected for the sake of clarity. However, the invention is not intended to be limited to the specific terms so selected, and it is to be understood that each specific term includes all technical equivalents that operate in a similar manner to accomplish a similar purpose.

Advantages

From the description above, several advantages of embodiments of the mounted flip frame (the frame) become evident. A summary of these advantages is listed below.

The smooth and operationally simple flipping mechanism uses a single finger swipe that is familiar to users of modern touch screens and smart phones. The flipping further produces a tactile satisfaction in the user as the frame retracts and is retained through automatic means.

The design of the frame uses two pair of exposed pivot arms. These pivot arms provide a clear, visual indication that frame is designed to be rotated. They entice the user to initiate the first flip, and then encourage the user to continue flipping to 1.) gain proficiency in the flipping action, and 2.) see the other side of the displayed item.

The frame is retracted by small torsion springs in the first embodiment. The resulting retraction acts to close the frame automatically. Other retraction means (rubber bands, weights, or motors) are also viable.

Two pivot arms are used to simplify the flipping and provide unbiased, bi-directional flipping. The slotted, retractable pivot arms and pivot pin(s) guide the rotation to a point above the fixed mount where a single pivoting axis can be used to turn it with minimal force. The design further reduces the friction necessary to flip because there is less friction against a retracting pivot arm than a fixed pivot arm. An additional benefit is that the frame flips faster than other designs, typically less than one second.

Using two pairs of pivot arms allows the frame to be rotated directly without an intervening hinge that would require a second manual operation (or a second hand). Note that one pivot arm, or a single pair of pivot arms might also be used to perform this flipping operation, but with the limitations noted.

The two-pivot, coaxial flipping design allows frames to be mounted closer to each other on the wall than some previous prior art examples. This allows for a tighter grouping of pictures for families, teams, and the like.

The frame is wall-mounted. This deters theft as compared with many reversible prior art examples that are table mounted or have a trivial frame removal. The fixed mounting of the double sided object within the frame reduces risk of dropping or otherwise damaging the contents during the flipping action.

The height of the frame above the mounting surface ensures that the mounting surface will not be damaged by finger smudges. Using two pairs of pivot arms and a fixed mount further reduce other types of wall damage by induced by rotational forces in the prior art (See SUDACK, JAKE and ADLER).

The provision for using mounting strips further protects the wall by eliminating the need for holes (if security is less important). Mounting to glass, finished wood, or other non-traditional surfaces is also possible without damaging the surface. The mount under cavity allows the frame to stick closer to the wall once the mounting strips are installed.

Rare cards or documents can be damaged by poor handling. The frame's magnetic holder is specifically designed to limit the shifting and jostling of the contents within the frame to limit scratches and long-term damage. This protection is also given to photos, artifacts, and other valuable double sided items that might be enclosed in the frame.

Collectable metal coins and other metal artifacts need to be housed in an environment free from corroding acid present in wood and many other frame materials. The frame's acid-free or low-acid components mitigate the long-term risk of corrosion for coins and other metal objects in the frame.

Conclusions, Ramifications, and Scope

The reader will see that at least one embodiment of the mounted flip frame can be used to flip double sided objects with a single finger swipe. The instantaneous nature of the flip provides the curious with a rapid way to see the other side of double sided objects. The visible pairs of pivot arms identify that this is a mounted flip frame, which will become more evident as the frames are popularized. The popularity of fidget toys, the adoption of smart phones, and the reduced attention spans of the modern era suggest that the time has come for a single motion swipe to change sides of a mounted physical display.

The frame's swiping action is enabled by the swinging pivot arms and enhanced by the automatic retraction and retention. The spring-loaded retraction and retention provide a pleasing automatic closure experience to the user that encourages repeating. While retraction and retention means are not essential for the operation of the frame, they enhance and simplify the user's flipping experience. The user desires to test their proficiency in making a swipe that flips the contents cleanly without delay. With this frame the double sided object provides an excuse to use the frame, rather than prior art implementations with hidden or complicated methods that discouraged flipping. The frame is flipped, level and ready for viewing in fractions of a second.

Collectors desire that their assets be protected against damage. Dropping, scratching, tearing, fading, corroding, or otherwise mishandling these assets can substantially devalue a collectible. The mounted flip frame addresses each of these concerns, unlike virtually all prior art examples. In this embodiment, cards and coins are protected from physical damage by their insertion into a hard plastic magnetic holder designed and used by collectors to house them. Once the display item is installed in the holder and then in the frame, the likelihood of damage is essentially eliminated.

A less obvious feature of the first embodiment is that the magnetic holder it uses is a standard size for the US-63.5 mm×88.9 mm (2.5 inch×3.5 inch). This size supports virtually all sports and trading cards sold in the US since 1957. It is also the size of a standard school picture wallet size photo, children's team photos, and is also large enough to hold most vintage cards. This size also can fit playing cards, and game cards (e.g., Pokémon, Yu-gi-oh, Magic the Gathering, etc.). While this embodiment and magnetic holder are ideal for collectors, other embodiments of alternate sizes and shapes are readily obtained by enlarging the components shown herein. For example, standard picture frames sizes, graded card or coin slab sizes, or custom sizes for common double sided objects (e.g. 8×10 photos, comic books, documents) are also viable, and magnetic holders for these sizes are currently available.

Other embodiments may use the first embodiment to show before and after pictures, Event tickets, photos, autographs, golf cards or other double sided images. Even single sided photos or items can be enhanced by providing a context statement that describes the significance of the item or display item as well as pertinent information. In this embodiment the frame might be used as a more active alternative to the boxes, levers or sliding panels that museums use to reveal an answer when moved.

The alternative embodiments shown in FIGS. 10, 11, and 12 show the versatility of the frame by demonstrating simple mechanisms for lighting the display item, flipping it automatically via a switch (or potentially a remote control), or creating a wall-mounted, double sided gaming platform. A game frame might also include features (not shown) such as levers, launchers, balancing elements, displays, or other common game features to enhance the game play. This game frame might provide a reverse side for continued play, an alternate display, or a completely different game. The reversible nature of the game frame allows for a choice to the user on which game they may choose to play. The small, wall-mounted games might be used to entertain waiting patrons at amusement parks, restaurants, museums, or other locations where a game wall might enhance the customer experience. The game frames can also be removed from the frame and played as a hand-held device.

The labels presented in FIG. 12 can also provide a secondary function. In addition to providing a QRC code and/or other manufacturing information, these labels might be used to add collective appeal. For example, the mount might have a holographic label, a special edition label, or a display item count number (for example, 1 of 1000 of a specific frame build). The sealed, boxed frames themselves might provide this value, with inserts containing a pre-installed rare collectible card, or a ticket to an event, for example. These embodiments enhance the value of the mounted flip frame by making the frame itself a collectible item.

Alternative mountings could also be used. An example embodiment could use magnets mounted on the bottom of the mount to hold the frame to a refrigerator, for example.

Although the description above contains many specificities, these should not be construed as limiting the scope of the embodiments but as merely providing illustrations of some of the embodiments. For example, the frame can have a single pivot arm or a single pair of pivot arms; use alternate materials; use end caps for the magnetic holder instead of a physical frame; use parts scaled larger or smaller; have different attachment means; use other retraction mechanisms, etc.

While at least one exemplary embodiment of the present invention(s) is disclosed herein, it should be understood that modifications, substitutions, and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both, unless this application states otherwise. Furthermore, characteristics or steps which have been described may also be used in combination with other characteristics or steps and in any order unless the disclosure or context suggests otherwise. This disclosure hereby incorporates by reference the complete disclosure of the provisional application to which it claims benefit or priority.

Accordingly, the scope of the disclosure should be determined not by the embodiment(s) illustrated, but by the appended claims and their legal equivalents.

I claim:

1. A mounted flip frame comprising:

a mount assembly, for mounting a frame assembly, the mount assembly having an outer periphery, an inner periphery, and at least a first side and a second side that is parallel to the first side, the mount assembly having an essentially planar back surface and being adapted to be fixedly attached to an essentially planar surface;

the frame assembly for displaying both sides of a double sided item having an essentially planar surface, the frame assembly having at least a first side and a second side that are parallel to the first side, and second sides of the mount assembly, the frame assembly having a cavity for displaying the double sided item, the frame assembly being movably connected to the mount assembly;

a first slotted pivot arm for pivoting the frame assembly, the first pivot arm having a first end and a second end, the second end having a slot running through its centerline from near the second end to about the midpoint of the first slotted pivot arm, the first end being rotatably attached to the outer periphery of the first side of the mount assembly at the corner of the mount assembly;

a second slotted pivot arm for pivoting the frame assembly, the second pivot arm having a first end and a second end, the second end having a slot running through its centerline from near the second end to about the midpoint of the second slotted pivot arm, the first end of the second slotted pivot arm being rotatably attached to the outer periphery of the mount assembly at the opposite corner of the first side of the mount assembly from that of the first slotted pivot arm;

a biasing mechanism for biasing the first and second pivot arms at the rotatable attachment to the mount assembly that biases the pivot arms to a retracted or closed position where the frame assembly and mount assembly are parallel and touching;

a pivot pin for connecting the mount assembly to the frame assembly, the pivot pin having one large end to limit it from going through the pivot arm slots, and a second, smaller end that allows the pivot pin to be routed through the slots of the first and second pivot arms and attach fixedly to the frame assembly at approximately the midpoint of the first side, using an integrated receptacle for the second smaller end in the frame assembly, the pivot pin rotating freely in the slots of both the first and second pivot arms whereby, in the retracted or closed position, the pivot arms are notionally parallel to the plane of the frame assembly and the mount assembly, but in an extended or open position the pivot arms are raised above the plane of the mount assembly to the extended position that allows the frame assembly to rotate freely about the pivot pin, in either direction, about an axis notionally centered above the mount assembly.

2. The mounted flip frame of claim 1 wherein a second pair of pivot arms and a second pivot pin on the second side of the frame assembly and mount assembly are added to produce the same motion and forces on the second side of the mounted flip frame, resulting in a mounted flip frame that is less vulnerable to damage caused by the forces applied on the first side of the frame assembly and mount assembly during flipping.

3. The mounted flip frame of claim 1 wherein a magnetic holder is used within the frame assembly cavity to hold the double sided item and provide physical and ultraviolet protection using acid free materials to safeguard the double sided item once housed therein.

4. The mounted flip frame of claim 3, wherein a lighting source, a battery, and a switch are mounted within the frame assembly and are used to illuminate both sides of the double sided item simultaneously by directing light into the edge of the magnetic holder.

5. The mounted flip frame of claim 1 wherein the biasing mechanism is a spring.

6. A method for flipping a double sided frame assembly rotatably attached to a fixed mount assembly with a single finger swipe, the double sided frame assembly comprising a first slotted pivot arm and a second slotted pivot arm, the method comprising:

placing a finger at the junction of the frame assembly and the mount assembly on either of the sides parallel to a pivot axis;

lifting the frame assembly with the finger in a semicircular fashion to rotate it to a point where the body of the frame assembly is notionally perpendicular to that of said fixed mount assembly;

flicking the frame assembly in the same direction;

allowing an incorporated retraction mechanism in the mount assembly to retract the frame assembly whereby the opposite side is displayed in a level and flat manner, parallel to the fixed mount assembly.

* * * * *